US011428074B2

(12) United States Patent
Paton

(10) Patent No.: US 11,428,074 B2
(45) Date of Patent: Aug. 30, 2022

(54) MAGNETIC CLEANING APPARATUS AND METHOD OF USE THEREOF

(71) Applicant: SUB-DRILL SUPPLY LIMITED, Aberdeenshire (GB)

(72) Inventor: Mark Paton, Aberdeenshire (GB)

(73) Assignee: SUB-DRILL SUPPLY LIMITED

( * ) Notice: Subject to any disclaimer, the term of this patent is extended or adjusted under 35 U.S.C. 154(b) by 0 days.

(21) Appl. No.: 17/276,509

(22) PCT Filed: Sep. 16, 2019

(86) PCT No.: PCT/GB2019/052599
§ 371 (c)(1),
(2) Date: Mar. 16, 2021

(87) PCT Pub. No.: WO2020/058687
PCT Pub. Date: Mar. 26, 2020

(65) Prior Publication Data

US 2021/0246762 A1 Aug. 12, 2021

(30) Foreign Application Priority Data

Sep. 17, 2018 (GB) ..... 1815113

(51) Int. Cl.

| | |
|---|---|
| ***E21B 37/00*** | (2006.01) |
| ***B03C 1/02*** | (2006.01) |
| ***B08B 7/00*** | (2006.01) |
| ***B08B 9/04*** | (2006.01) |

(Continued)

(52) U.S. Cl.
CPC ..... *E21B 37/00* (2013.01); *E21B 31/06* (2013.01); *B03C 1/02* (2013.01); *B03C 2201/20* (2013.01); *B03C 2201/22* (2013.01); *B08B 7/00* (2013.01); *B08B 9/04* (2013.01); *B08B 2209/04* (2013.01); *H01F 7/02* (2013.01)

(58) Field of Classification Search
CPC . E21B 37/00; E21B 31/06; B03C 1/02; B03C 2201/20; B03C 2201/22; B08B 7/00; B08B 9/04; B08B 2209/04; H01F 7/02
See application file for complete search history.

(56) References Cited

U.S. PATENT DOCUMENTS 6,655,462 B1 * 12/2003 Carmichael ..... B08B 9/0553 166/173
6,702,940 B2 3/2004 Blange
9,708,890 B2 7/2017 Skjeie
(Continued)

OTHER PUBLICATIONS

International Search Report and Written Opinion dated Feb. 20, 2020 issued in corresponding International Application No. PCT/GB2019/052599.

*Primary Examiner* — Christopher J Sebesta
*Assistant Examiner* — Neel Girish Patel
(74) *Attorney, Agent, or Firm* — Onello & Mello, LLP

(57) ABSTRACT

The present invention relates to a magnetic cleaning tool (100) for removing ferrous debris from within a BOP, riser or wellbore, the tool comprising: a tool body having a longitudinal axis, and one or more magnets (104) configured to rotate around an axis substantially parallel to the longitudinal axis from a first position to a second position. In the first position the one or more magnets attract ferrous debris to a debris gathering surface, and in the second position the one or more magnets do not attract ferrous debris to the debris gathering surface.

26 Claims, 5 Drawing Sheets

(51) Int. Cl.
*E21B 31/06* (2006.01)
*H01F 7/02* (2006.01)

(56) References Cited

U.S. PATENT DOCUMENTS

| | | | | |
|---|---|---|---|---|
| 2002/0079998 | A1 | 6/2002 | Blange | |
| 2007/0267196 | A1* | 11/2007 | Mondelli | E21B 31/06 166/301 |
| 2014/0096972 | A1* | 4/2014 | Leiper | E21B 37/00 166/311 |
| 2015/0192000 | A1 | 7/2015 | Cooper | |
| 2016/0118919 | A1* | 4/2016 | Malone | H02P 29/028 318/400.42 |
| 2019/0249522 | A1* | 8/2019 | Ewing | H01F 7/064 |

* cited by examiner

MAGNETIC CLEANING APPARATUS AND METHOD OF USE THEREOF

The present invention relates to well cleaning equipment and more specifically to apparatus and methods for gathering and removing ferrous debris from an oil and gas well.

During drilling and completion of an oil and gas well, debris and foreign particles are deposited in the well bore, casing, liner or in equipment such as the Blowout Preventer (BOP), or in valves or pumps. Typically, the circulating fluid carries these deposits to the surface where the fluid is cleaned by passing the fluid over screens or through shakers and other surface equipment to remove debris before being recirculated into the well. The heavier of these deposits, such as metal shavings and other ferrous debris, can be left suspended or trapped in cavities in the wellbore, BOP, riser or any other area where the debris can settle in the wellbore. This can be problematic.

In this connection, well cleaning tools have been developed to help remove debris, particularly ferrous debris, from the circulating fluid and from inside the wellbore or equipment. Such tools can employ magnets to attract the ferrous material inside the well.

For example, a BOP cleaning tool is known from U.S. Pat. No. 9,708,890, where large magnets are used to remove metal debris from the wellbore. In this regard, several long Halbach magnet rods are placed in a non-magnetic housing in a circular pattern to give sufficient magnet projection and influence on magnetic debris to remove it and carry it out of the BOP and marine riser.

The tool is removed from the well with the ferrous material attached, which can then be cleaned by scraping the ferrous material from the surface of the tool. Advancements of this concept have been seen in, for example, European Patent 2,888,434 B1, which uses a sleeve to selectively cover the magnets. The magnets are covered whilst the tool is being run in hole (RIH) and the sleeve is pulled back to reveal the magnets when the tool is in a zone which requires cleaning. U.S. Pat. No. 6,655,462 B1 also discloses a magnetic well cleaning apparatus, where first and second arrays of magnets are relatively movable to change from an activated to a deactivated state, so that the tool can be deactivated prior to being RIH, and then activated when the tool is located in the zone which requires cleaning.

A disadvantage of these magnetic tools is that while they can be prepared for selective activation, after use they are not quickly and easily cleanable in preparation for being run into the well again. Furthermore, it is undesirable to create a magnetic field within the internal annulus of the work string as ferrous materials are attracted to the magnets as they travel down the internal annulus, and this may lead to a reduced diameter or blocking in the region of the magnets.

It is an object of the present invention to provide an apparatus and a method which seek to overcome one or more of the above problems.

According to a first aspect of the present invention, there is provided apparatus for removing debris from a well bore or from components in the wellbore, the apparatus comprising: a main body having a longitudinal axis; one or more magnetic assemblies, provided on the main body, each magnetic assembly having an assembly axis that is spaced from and substantially parallel to said main body axis, each magnetic assembly further having one or more elements that are movable about their assembly axis between a first position for attracting debris and a second position for restricting attraction of debris.

Such apparatus allows for the attraction of ferrous debris to be controlled such that, when desired, the ferrous debris can be removed quickly and easily, saving time between runs of the tool.

Preferably, each magnetic assembly comprises one or more magnets, conveniently provided as an array of a plurality of magnets. Using a plurality of magnets together in an array can create a strong magnetic field which covers a larger area than a single smaller magnet.

Preferably, the array is arranged with magnets of opposite polarity situated adjacent one other. Each array may comprise any suitable number of magnets coupled together, depending upon circumstances. Conveniently, each array can comprise up to 32 magnets coupled together.

Conveniently, the one or more magnets are permanent magnets.

Preferably, the one or more elements comprise said one or more magnets, the one or more magnets being movable about their assembly axis.

The one or more elements may alternatively comprise a movable sleeve, movable about its assembly axis.

Preferably, the main body comprises a central tube section.

Conveniently, the apparatus comprises a plurality of magnetic assemblies.

Preferably, the magnetic assemblies are provided circumferentially about the main body. In this manner, the apparatus can collect debris circumferentially within the wellbore or wellbore component.

Conveniently, the apparatus comprises two to ten magnetic assemblies. Preferably, the apparatus comprises three to eight magnetic assembles, and yet more preferably the apparatus comprises six magnetic assemblies.

Preferably, each magnetic assembly further comprises a debris gathering cover surface. This may be formed of a non-magnetic material to aid in the debris removal process.

Conveniently, each magnetic assembly comprises an elongate chamber housing said one or more rotatable elements.

Preferably, the one or more rotatable elements comprise a magnetic array having a substantially hemi-cylindrical configuration.

Conveniently, the magnetic array comprises a plurality of substantially hemi-cylindrical segments of alternating polarity laminated together.

Preferably, the magnetic array is mounted on a magnetic flux insulating plate for restricting passage of magnetic flux therethrough.

Conveniently, the elongate chamber has a substantially cylindrical configuration having a substantially semi-cylindrical base recess. Whilst a substantially semi-cylindrical cover for the chamber is preferred, the cover may, in alternative embodiments, be any suitable shape, such as rectangular.

Preferably, the base recess is formed of magnetic flux insulating material for restricting passage of magnetic flux therethrough.

Conveniently, whilst the base recess and magnetic array plate may be formed of any suitable magnetic or non-magnetic material, they preferably comprise stainless steel. The base recess and magnetic array plate may comprise AISI 304 or AISI 316. The use of stainless steel helps to protect against corrosion. The base recess or magnetic array plate can be formed from any magnetic or non-magnetic material.

Preferably, in the first position the one or more magnets create a magnetic field with a field depth of around 2 cm to 8 cm. This is typically deep enough that the magnetic field will be suitably powerful where required. A greater depth than 8 cm may be counterproductive, as it will be unlikely to catch any more materials than a 8 cm field depth since it will be propagating into the formation rather than only into the wellbore, and also it may create too strong a magnetic field which could interfere with other equipment in the wellbore or have the undesired effect of attracting other larger ferrous objects, other than just debris, to the magnets.

Conveniently, the base recess comprises ferromagnetic filler material. This material negates the effect of the magnetic field created by the magnets when the magnets are in the second position.

Preferably, the magnetic material used is a neodymium material. This material is particularly suitable as it performs well at high temperatures (−150 degrees Celsius) which are typical in the wellbore.

According to a second aspect of the present invention there is provided a magnetic assembly for use in wellbore cleaning apparatus, the assembly comprising a substantially cylindrical chamber housing a hemi-cylindrical magnet array, rotatable between a first position where magnetic flux emanates from the assembly and a second position where emittance of magnetic flux is restricted.

Preferably, a plurality of assemblies are mounted around a tubular member having a first end and a second end releasably engagable into a drill string or specialist assembly such as a cleaning or milling assembly.

Conveniently, the plurality of assemblies are spaced and positioned such that magnets of the magnet array together form a Halbach array around the circumference of the tubular member.

The magnetic assembly may further comprise a linkage configured to link the rotation of the magnet arrays of each assembly such that they will rotate together.

According to a third aspect of the present invention there is provided a method of cleaning ferrous debris from a wellbore or components in the wellbore using apparatus as defined above, the method comprising the steps of: providing the apparatus within a target area to be cleaned with the one or more magnets to the first position to attract ferrous debris; removing the magnetic cleaning tool from the target area; and moving the one or more magnets to the second position to facilitate the release of the ferrous debris.

An embodiment of the invention will now be described, by way of example only, and with reference to the following drawings, in which.

Figure 1:
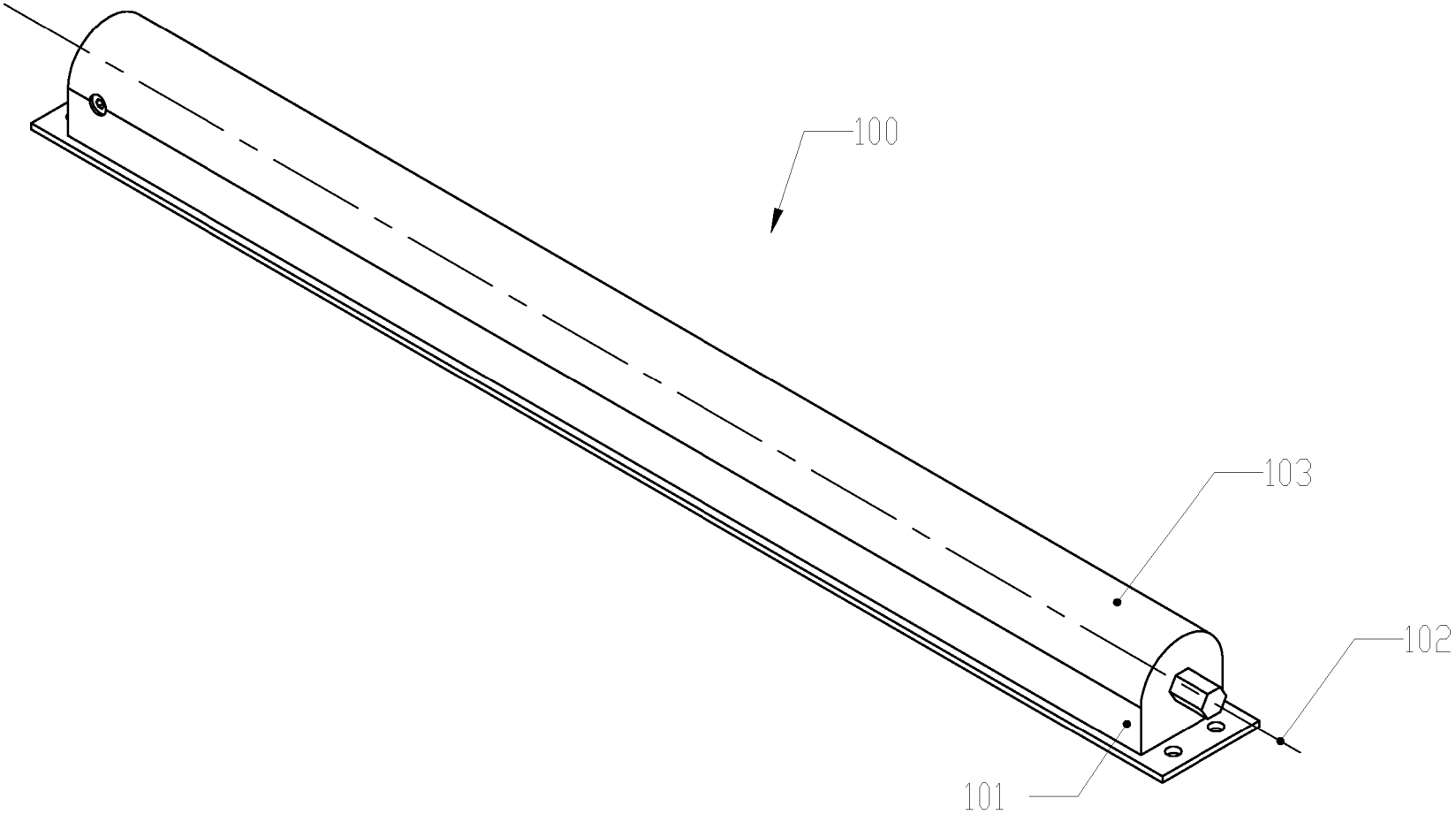
FIG. 1 shows a magnetic assembly in accordance with the present invention.
Figure 2:
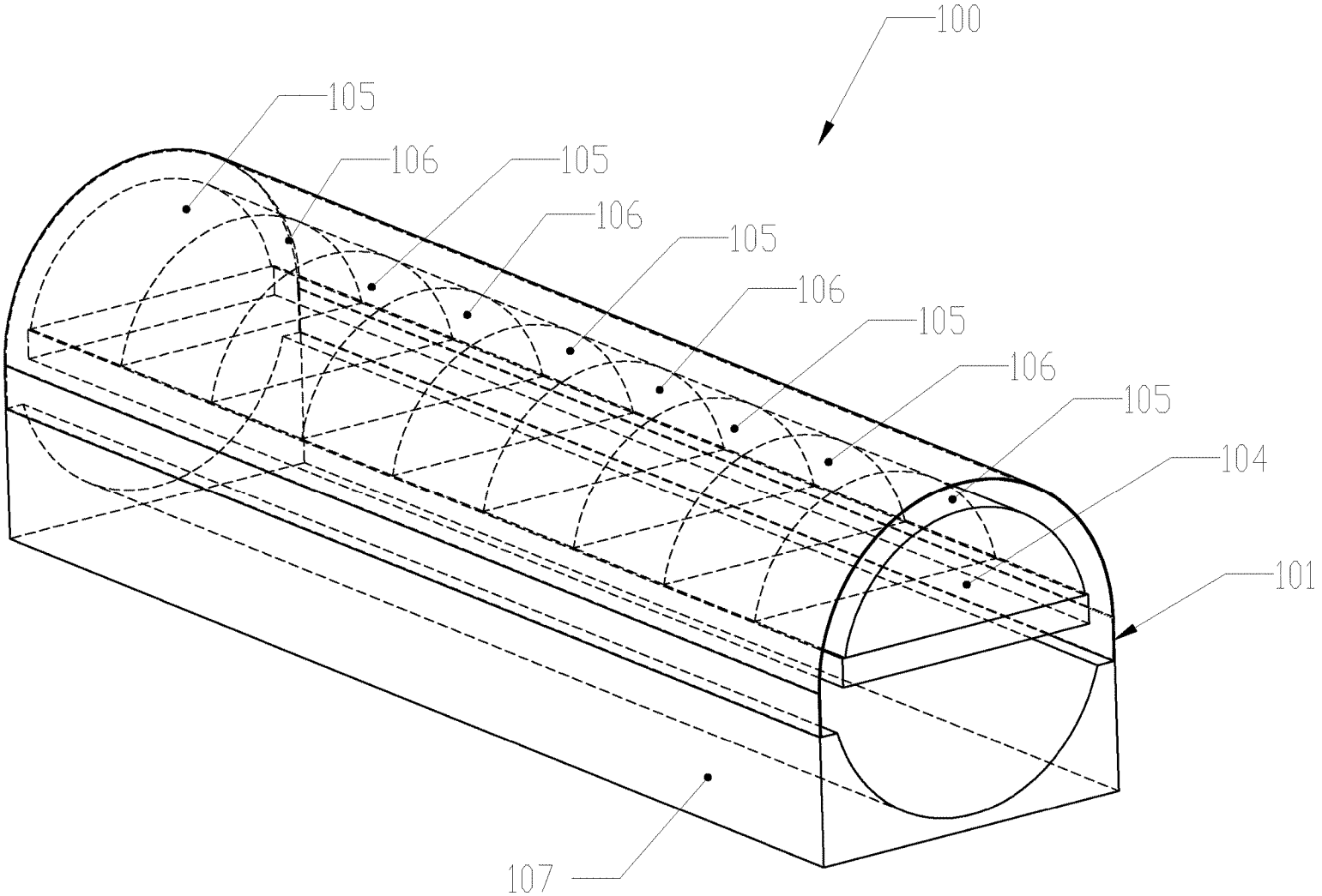
FIG. 2 shows the magnetic assembly of FIG. 1 in more detail.
Figure 3:
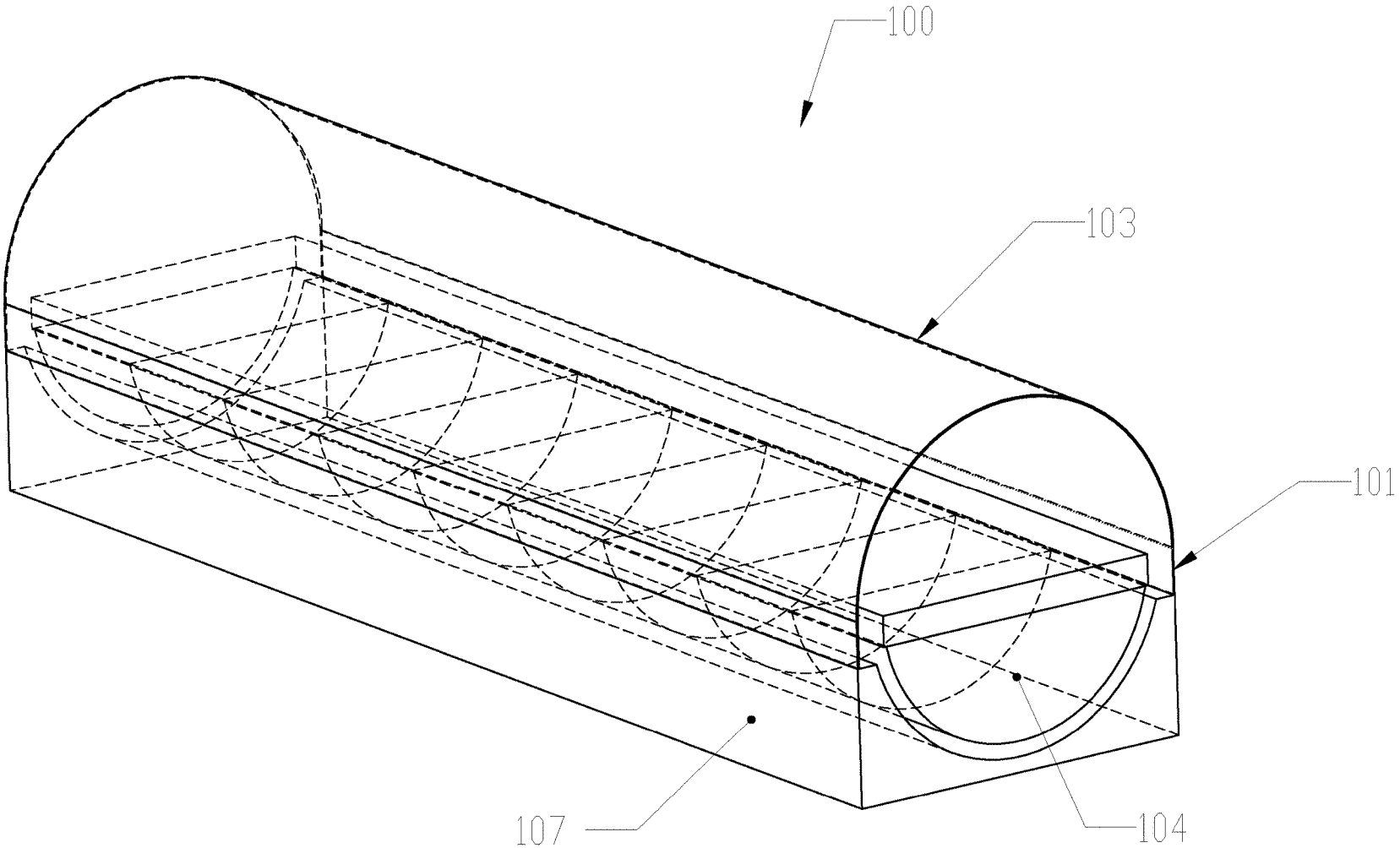
FIG. 3 shows the magnetic assembly of FIG. 1 in more detail.
Figure 4:
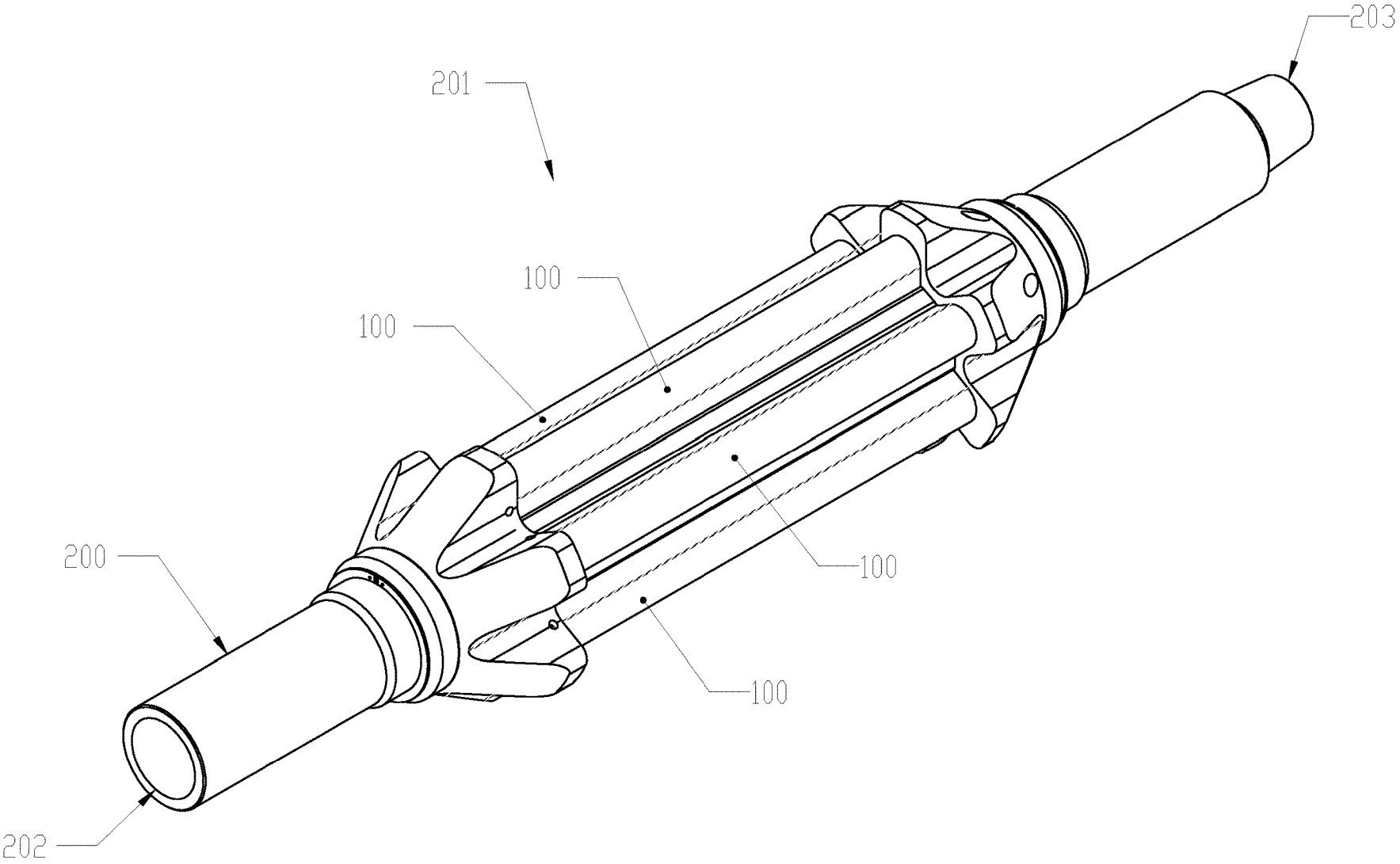
FIG. 4 shows apparatus in accordance with the present invention.
Figure 5:
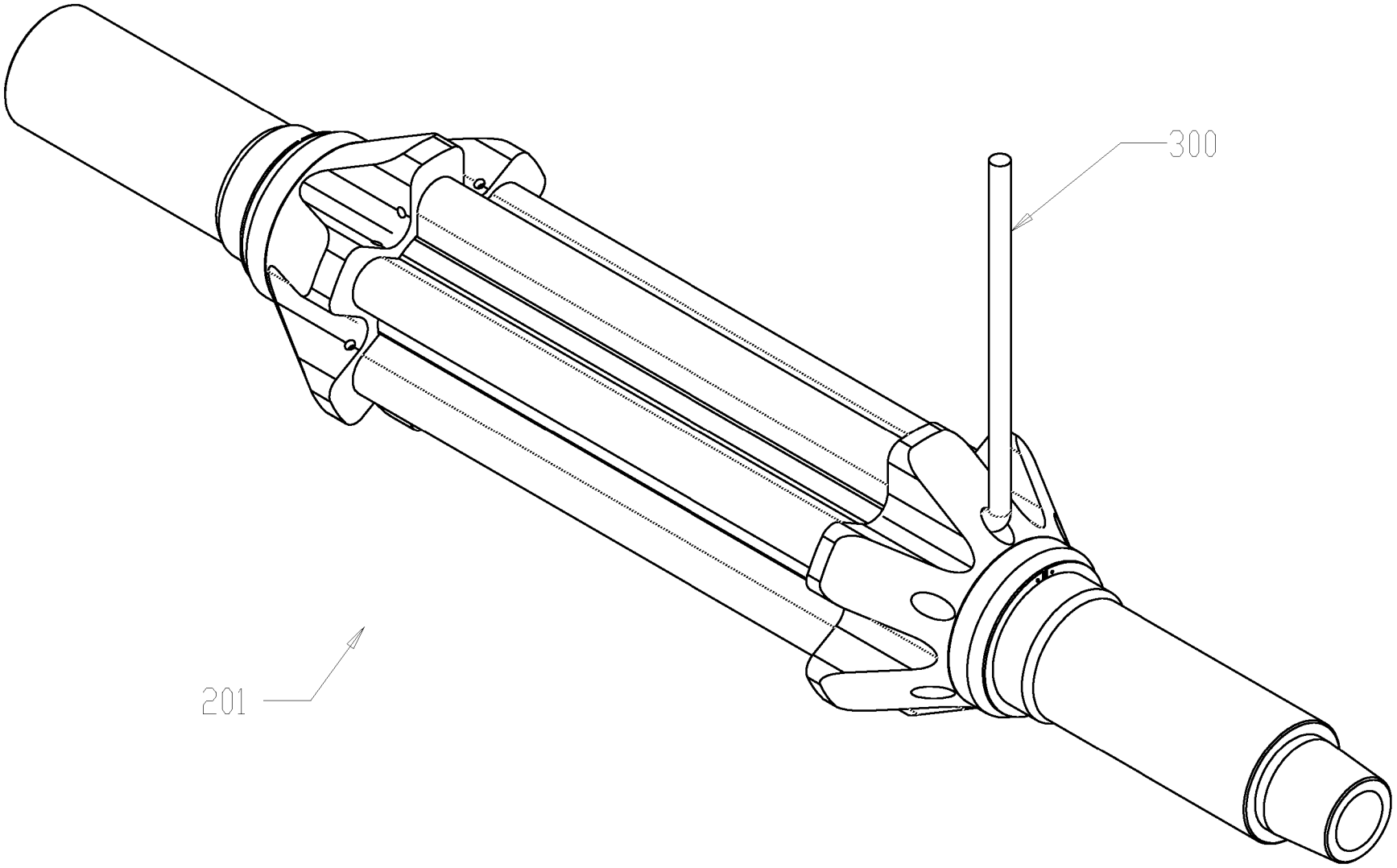
FIG. 5 shows the apparatus of FIG. 4 with an additional optional feature.

FIGS. 1-3 show a magnetic assembly 100 of a preferred embodiment of the present invention for use with the apparatus 201 of FIGS. 4 and 5, which is deployed to remove ferrous debris from within a wellbore or from components within the wellbore. The magnetic assembly comprises an elongate chamber 101 having a longitudinal axis 102 and a debris gathering surface 103. The chamber 101 is preferably made of a non-magnetic material such as stainless steel. Whilst other suitable materials may be employed, the use of stainless steel helps to protect the chamber from corrosion. AISI 304 and AISI 316 are typical stainless steels that may be used in this environment, and are also non-magnetic.

As shown in FIG. 1, whilst the debris gathering surface 103 is on the outside of the chamber, it will be understood that the debris gathering surface 103 could equally be positioned behind a filter or screen or in some other way within the chamber 101.

As shown in FIG. 2, the magnetic assembly 100 has an array of magnets 104, which preferably are orientated to alternate in polarity, for example north pole orientated magnets 105 are positioned adjacent south pole orientated magnets 106. The magnets 104, in the preferred embodiment shown, are permanent magnets, however it will be appreciated that the invention could work equally well with electromagnets.

The magnetic assembly 100 is to be deployed in extreme environments within the wellbore, where temperatures can be around 150 degrees Celsius, such that high performing magnetic material is preferably used, for example a neodymium material.

In the embodiment shown the chamber 101 and the array of magnets 104 each form a rod like structure, with the array taking a hemi-cylindrical form.

The magnets 104 are movable, e.g. rotatable in the present example, from a first position (as shown in FIG. 2) to a second position (as shown in FIG. 3). In the first position, the magnets create a magnetic field at the outside of the chamber 101, adjacent the debris gathering surface 103, thus attracting ferrous debris to the debris gathering surface 103. The magnetic field depth is typically around 2 cm to 8 cm, as this is typically deep enough that the magnetic field will be present everywhere in the outer annulus of the wellbore (created between the work string and the wall of the wellbore), and as such ferrous materials present anywhere in the outer annulus will be under the force created by the magnetic field. A greater depth than 8 cm may be counterproductive, as it will be unlikely to catch any more materials than a 8 cm field depth since it will be propagating into the formation rather than only into the wellbore, and also it may create too strong a magnetic field which could interfere with other equipment in the wellbore or have the undesired effect of attracting other larger ferrous objects, other than just debris, to the magnets 104.

The magnets 104 rotate about an axis 102 of the assembly, which is spaced from and parallel to the longitudinal axis of the apparatus 201, by virtue of each assembly 100 being mounted circumferentially around the apparatus. The magnets 104 can rotate from the first position to the second position.

In the second position, shown in FIG. 3, the magnets have been rotated away from the debris gathering surface 103, thus removing the magnetic field from being adjacent the debris gathering surface 103, and therefore aiding in the releasing of any ferrous debris which has been attracted to the debris gathering surface by the magnets 104 when they were in the first position. To ensure that the magnetic field is negated as much as possible to facilitate release the ferrous debris, a ferromagnetic filler material 107 may be present in the tool body 101 at a region adjacent the magnets when they are in the second position. The magnets are also provided on plate of magnetic flux insulating material, which in the second position acts as a barrier to magnetic flux emission.

The rotation of the magnets 104 may be performed by any known means, such as a mechanical or hydraulic actuator, or the magnetic assembly 100 may further comprise a rotatable shaft connected to the magnets such that they can be rotated by hand.

As shown in FIGS. 4 and 5, a plurality of assemblies 100 are mountable on a cylindrical tubular member 200, creating a tool 201 for positioning within a work string. The cylindrical tubular member 200 may be an existing downhole tool, with the magnetic cleaning tool 100 being added as an additional feature to an existing tool, or the cylindrical tubular member 200 may be a bespoke component designed specifically for attaching the magnetic cleaning tool 100 thereto. The cylindrical tubular member 200 is configured at a first end 202 and second end 203 to releasably engage with other components of a work string, such that it can be positioned within a work string or drill string. Typically, the configuration chosen may be a pin connection and a box connection at the first and second ends, which is well known within the industry.

Preferably three to eight magnetic assemblies 100 are equally spaced around the cylindrical tubular member 200 (the arrangement shown in FIG. 4 has six magnetic assemblies). The magnetic assemblies 100 may be arranged in a Halbach array so that when the magnets 104 are in the first position they create an augmented magnetic field within the outer annulus (created between the work string and the wall of the wellbore) and a near-zero magnetic field in the inner annulus (within the central bore of the cylindrical tubular member 200. This is desirable as the assembly should collect and retain ferrous debris from the outer annulus, but should not collect ferrous materials in the inner annulus. There may be some ferrous materials returned to the wellbore in the circulating fluid if it has not been cleaned properly, however collection on the walls of the inner annulus could lead to restricted flow of the circulating fluid or a complete blockage of the inner annulus. The arrangement of the magnets 104 to create a Halbach array when they are first position, combined with the nulling of the magnetic field when they are rotated into the second position, ensures that a strong magnetic field is only created in the outer annulus of the wellbore, where the assembly can collect ferrous debris without risking blockage of the inner annulus.

When a plurality of magnetic assemblies 100 are used, they may be connected by a linkage which is configured to link the rotation of each of the magnet arrays 104 such that they will rotate together, thus allowing all magnet arrays 104 to be moved from the first position to the second position at the same time. This both improves the speed with which the tool 201 can be cleaned of ferrous debris.

A method of cleaning ferrous debris from within a wellbore or a wellbore component is now described. The method uses the magnetic tool 201, as shown in the Figures. The method involves the steps of providing the magnetic tool 201 within a target area of the wellbore which is to be cleaned, and then moving the one or more magnets 104 of the tool to the first position to attract ferrous debris to the debris gathering surface. The tool 201 is then removed from the target area, and the one or more magnets 104 are moved to the second position to facilitate the release of the ferrous debris from the debris gathering surface.

The magnets of the tool may be arranged in a Halbach array around the circumference of a cylindrical tubular member 200.

In the above method, it will be appreciated that the magnets 104 may already be the first position when the method starts, and so the step of moving the magnets 104 to the first position within the target zone would not be required if they are already in this position. It may be desirable to run the magnetic tool 201 into the well in the magnetized (magnets 104 in first position) or un-magnetized (magnets 104 in second position) state, depending on the other magnetic components within the well and on the area to be cleaned and the likelihood of there being large ferrous debris which would be attracted to the tool whilst running in hole.

Referring now to FIG. 5, the tool may be provided with a magnet rotation means 300 for effecting rotation of each of the magnet arrays 104 from the first position to the second position. This rotation may be provided by mechanical, hydraulic or any other suitable means.

In an alternative embodiment, based on the first embodiment with magnetic assemblies positioned circumferentially around a central tubular member, each magnetic assembly may have a magnetic array fixed in position, with a semi-cylindrical sleeve arranged to be movable from a first position where the array is exposed for attracting debris and a second position where the array is covered by the sleeve to restrict debris attraction. As such, relative movement of the sleeve and the magnetic array of each assembly allows the assembly to be deployed between active and inactive configurations. The sleeve may in this regard be mounted for rotational movement about the array.

The invention claimed is:

1. Apparatus for removing debris from a wellbore or from components in the wellbore, the apparatus comprising:

a main body having a longitudinal axis; and one or more magnetic assemblies, provided on the main body, each of the one or more magnetic assemblies having an assembly axis that is spaced from and substantially parallel to said longitudinal axis, each magnetic assembly further having one or more elements that are movable about their assembly axis between a first position for attracting debris and a second position for restricting debris attraction;

wherein the one or more elements comprise one or more magnets, the one or more magnets each having an individual assembly axis, the one or more magnets being rotatably movable about their respective individual assembly axis.

2. Apparatus according to claim 1, wherein the one or more magnets of each magnetic assembly are provided as an array of a plurality of magnets.

3. Apparatus according to claim 2, wherein the array is arranged with magnets of opposite polarity situated adjacent one other.

4. Apparatus according to claim 1, wherein the one or more magnets are permanent magnets.

5. Apparatus according to claim 1, wherein the main body comprises a central tube section.

6. Apparatus according to claim 1, comprising a plurality of magnetic assemblies.

7. Apparatus according to claim 6, comprising 2 to 10 magnetic assemblies.

8. Apparatus according to claim 6, comprising 6 magnetic assemblies.

9. Apparatus according to claim 1, wherein each magnetic assembly further comprises a debris gathering cover surface.

10. Apparatus according to claim 1, wherein each magnetic assembly comprises an elongate chamber housing said one or more movable elements.

11. Apparatus according to claim 10, wherein the one or more movable elements comprise a rotatable magnetic array having a substantially hemi-cylindrical configuration.

12. Apparatus according to claim 11, wherein the magnetic array comprises a plurality of substantially hemi-cylindrical segments of alternating polarity laminated together.

13. Apparatus according to claim 11, wherein the magnetic array is mounted on a magnetic flux insulating plate for restricting passage of magnetic flux therethrough.

14. Apparatus according to claim 10, wherein the elongate chamber has a substantially cylindrical configuration having a substantially semi-cylindrical base recess.

15. Apparatus according to claim 14, wherein the base recess is formed of magnetic flux insulating material for restricting passage of magnetic flux therethrough.

16. Apparatus according to claim 14, wherein the base recess and magnetic array plate comprise stainless steel.

17. Apparatus according to claim 16, wherein the base recess and magnetic array plate comprise AISI 304 or ASIS 316.

18. Apparatus according to claim 14, wherein the base recess comprises ferromagnetic filler material.

19. Apparatus according to claim 18, wherein the ferromagnetic filler material is arranged to oppose a magnetic field created when the one or more magnets are in the second position.

20. Apparatus according to claim 1, wherein in the first position the one or more magnets create a magnetic field with a field depth of around 2 cm to 8 cm.

21. A method of cleaning ferrous debris from a wellbore or components in the wellbore using apparatus as claimed in claim 1, the method comprising the steps of:

providing the apparatus within a target area to be cleaned with the one or more magnets to the first position to attract ferrous debris;

removing the magnetic cleaning tool from the target area; and moving the one or more magnets to the second position to facilitate the release of the ferrous debris.

22. Apparatus according to claim 1, wherein the magnetic assemblies are provided circumferentially about the main body.

23. A magnetic assembly for use in wellbore cleaning apparatus, the magnetic assembly comprising a substantially cylindrical chamber housing a hemi-cylindrical magnet array, rotatable within the chamber between a first position where magnetic flux emanates from the magnetic assembly and a second position where emittance of magnetic flux is restricted.

24. A magnetic assembly according to claim 23, wherein a plurality of assemblies are mounted around a tubular member having a first end and a second end releasably engageable into a drill string.

25. A magnetic assembly according to claim 24, wherein the plurality of assemblies are spaced and positioned such that magnets of the magnet array together form a Halbach array around the circumference of the tubular member.

26. A magnetic assembly according to claim 24, further comprising a linkage configured to link the rotation the magnet arrays of each assembly such that they will rotate together.

* * * * *